United States Patent [19]

Stemberger

[11] Patent Number: 4,517,861

[45] Date of Patent: May 21, 1985

[54] CONTINUOUS TRAVEL HAND WRENCH

[76] Inventor: Ivan Stemberger, 601 DuPont Plz., Miami, Fla. 33131

[21] Appl. No.: 516,577

[22] Filed: Jul. 25, 1983

[51] Int. Cl.[3] ..... B25B 17/00

[52] U.S. Cl. ..... 81/57.29

[58] Field of Search ..... 81/57.29, 57.26, 57.28, 81/177 E

[56] References Cited

U.S. PATENT DOCUMENTS 2,703,030 3/1955 Marvin ..... 81/57.29

4,455,896 6/1984 Holmes ..... 81/57.29

FOREIGN PATENT DOCUMENTS 13230 of 1903 United Kingdom ..... 81/57.29

*Primary Examiner*—James L. Jones, Jr.

*Attorney, Agent, or Firm*—John Cyril Malloy

[57] ABSTRACT

A wrench assembly of the type structured to be substantially continuously operated and hand held and manipulated which includes an adaptor structure which may be substantially continuously rotated and by virtue of its connection to a socket holder or like adaptor structure through appropriate drive components, such socket holder may be continuously rotated as long as the activating structure itself is continuously rotated.

7 Claims, 16 Drawing Figures

CONTINUOUS TRAVEL HAND WRENCH

BACKGROUND OF THE INVENTION

1. Field of the Invention

This invention relates to a wrench assembly which may be maintained in secured engagement with a nut or bolt through conventional socket structures and manipulated to cause continuous rotation of the engaged nut or bolt through continuous turning of activating components drivingly interconnected to the socket holder.

2. Description of the Prior Art

For many years efforts have been made to design a wrench which can operate in a conventional manner such as tightening or loosening nuts, bolts, screws, etc., without interrupting the progress of the manual work. Interruption generally occurs when the head of the wrench must be continuously removed and secured to the nut or bolt so as to reorient the wrench head and apply leverage to the nut or bolt in the well accepted manner. To some extent, conventional ratchet type wrenches overcome the problem of continuously removing the head of the wrench from the bolt. However, the ratchet wrench still has certain disadvantages associated with the reciprocal movement of the body of the wrench relative to the nut or bolt being rotated in order to apply leverage thereto.

Accordingly, there is a need in this art for a wrench structure which accomplishes all of the intended functions relating to the tightening or loosening of nut or bolt type connectors while at the same time being able to maintain a continuous grip of the connector and preferably maintain the same positioning of the wrench body once the connector has been grasped. In addition, the subject wrench should be of multi-purpose design suitable for any wrench application such as use in machine shops, automobile repair shops, aviation mechanics, and general maintenance.

Another problem associated with the use of conventional wrenches, including ratchet type wrenches, is directed towards the incidents where a loosened nut will not unthread as the conventional wrench is successively released and reapplied. This occurs because the whole bolt and nut assembly simply turns back and forth in its secured aperture. With the use of the preferred wrench of this invention, such an occurrence is less lkely to happen since torque is applied without interruption to the connector once it has been loosened from its original secured position.

In many cases the continuous travel hand wrench of the subject invention can replace compressed air and other power driven wrenches with no loss of performance. Finally, the design in construction of the preferred wrench should be simple and structurally sound so as to keep maintenance at a minimum and eliminate or reduce problems associated with tool wear or breakdown.

SUMMARY OF THE INVENTION

The present invention is directed towards a substantially continuous travel hand held and manipulated wrench assembly. More specifically, the assembly comprises a housing having a substantially elongated configuration and including a head portion at one end thereof. The head portion is structured to include a casing disposed in surrounding engagement to an adaptor means which may be in the form of a socket holder generally associated with conventional wrenches.

A drive means is disposed within the housing and includes in part a substantially elongated drive shaft. A first gear element is integrally formed on one end of the drive shaft adjacent to the head portion. A second gear element, which also defines a part of the drive means, is disposed in interconnected and meshing engagement with the first gear element of the drive shaft. Further, the second gear element is disposed in surrounded, supported relation within the casing of the head portion. This second gear element is also connected to rotate with the adaptor means or socket holder. Rotation or driving of the adaptor means occurs through manual rotation of the activating means. This activating means is secured to the housing and is directly connected so as to rotate with the drive shaft. Accordingly, rotation of the activating means relative to the housing causes rotation of the drive shaft which in turn causes intermeshing driving engagement between the first gear element and the second gear element and the attendant rotation of the wrench holder which defines the adaptor means.

The activating means may comprise a handle rotatably mounted at least in part on the exterior of the housing whereby rotation thereof relative to the housing causes the above-described driving rotation of the drive shaft. The activating means further comprises a crank assembly which is interconnected to the drive shaft through its direct attachment to the handle portion. The crank assembly includes a crank arm which may be selectively positioned between a stored, inoperative position, or an outwardly extended operative position. In its outwardly extended position, the crank arm is oriented at a substantially 90 degree angle to the axis of the drive shaft. Rotation of the crank arm relative to the housing may occur continuously and thereby cause continuous rotation of the drive shaft and the continuous rotation of the adaptor means.

Therefore, once the adaptor means has a wrench socket attached thereto, in the conventional fashion, the socket can be applied to a nut, bolt or like connector. Initial loosening of the connector may occur through leverage being applied to the housing in somewhat the conventional fashion. However, once loosened continuous rotation of the activating means, either in the form of the handle portion or the crank assembly, causes substantially continuous rotation of the drive means and similarly, continuous rotation of the adaptor means in the form of the socket holder. Accordingly, the wrench assembly can be substantially maintained in a single position continuously applied to the connector to be tightened or loosened and rotation of this connector can occur through continuous rotation of the activating means.

BRIEF DESCRIPTION OF THE DRAWINGS

In order to fully describe the present invention, reference is hereinafter made to the accompanying drawings, in which.

Similar reference characters refer to similar parts throughout the several views of the drawings.

DETAILED DESCRIPTION OF THE PREFERRED EMBODIMENT

Figure 1:
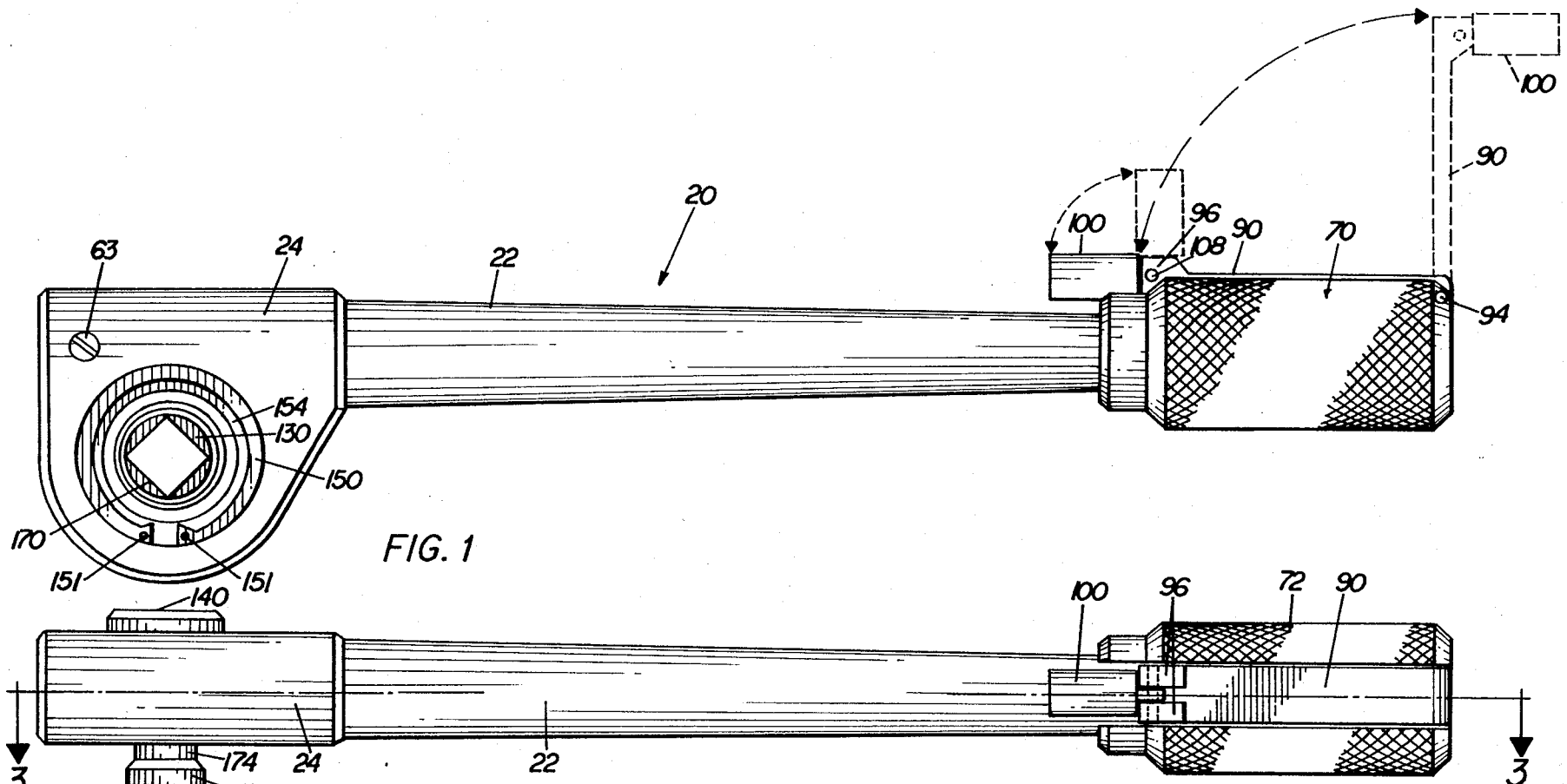
FIG. 1 is a bottom plan view of the wrench assembly of the present invention.
Figure 2:
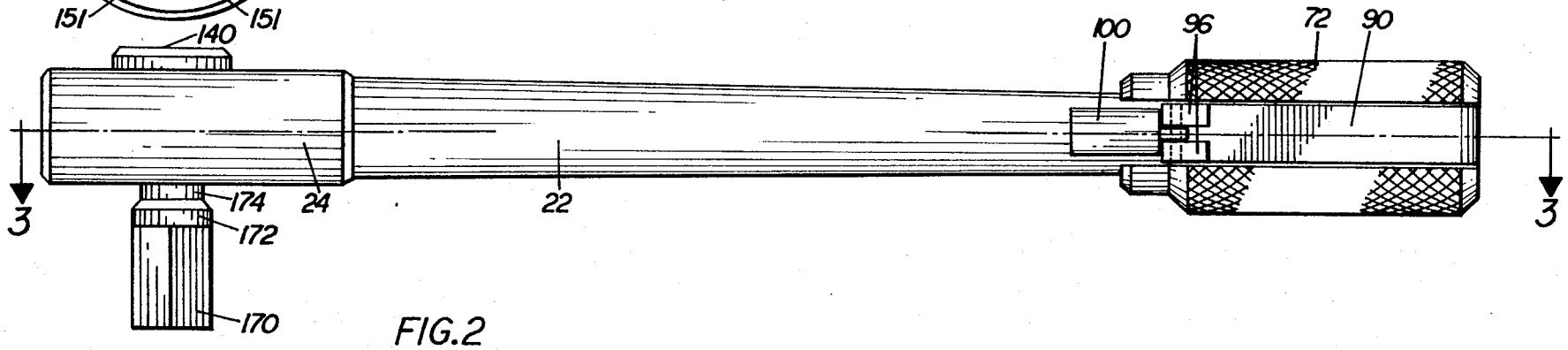
FIG. 2 is a side view of the subject wrench assembly.
Figures 3, 4, 5, 6, 7, 8, 9, 10, 11, 12, 13, 14, 15, 16:
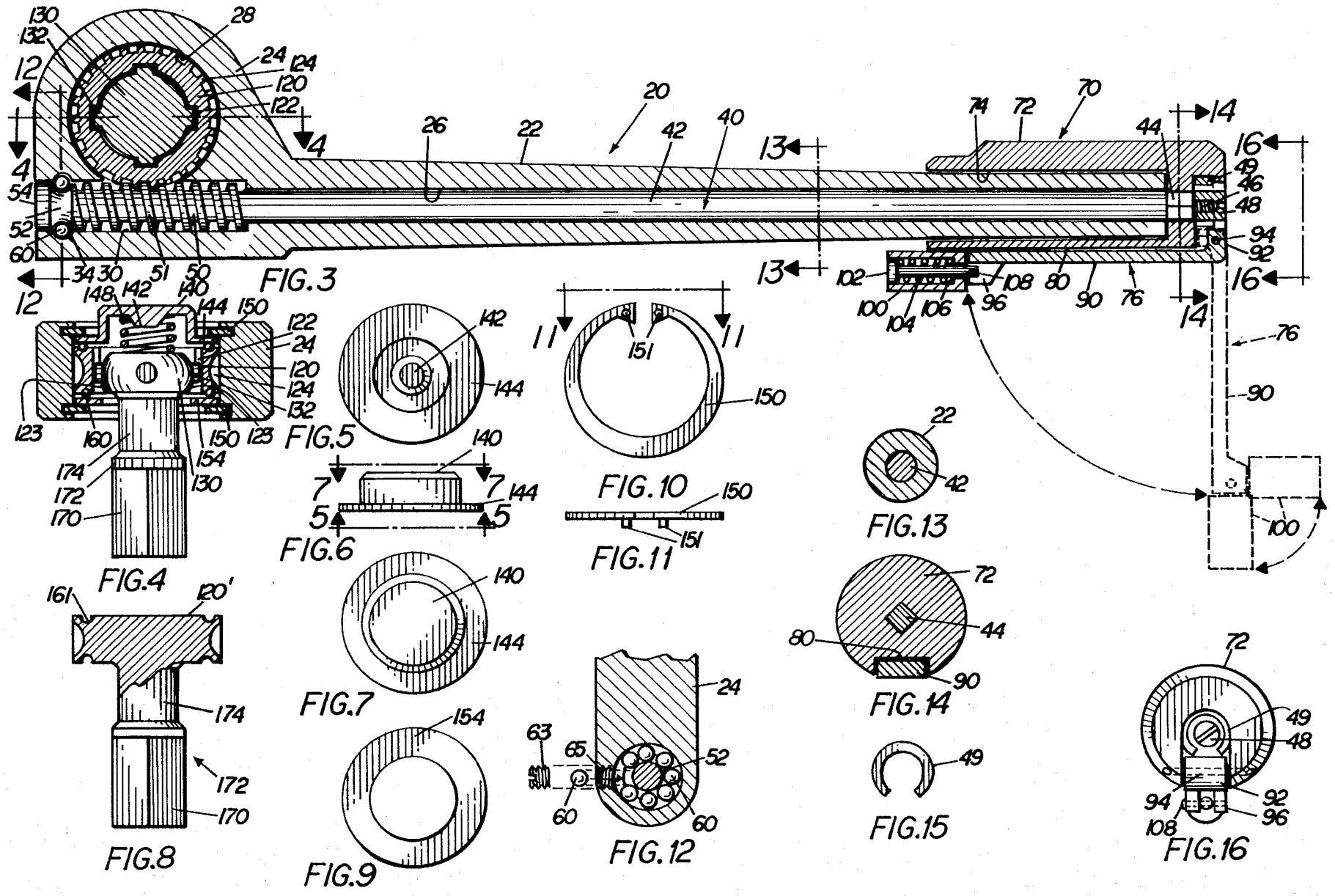
FIG. 3 is a sectional view taken along line 3—3 of FIG. 2.
FIG. 4 is a view in partial section showing details of the head portion and its supporting engagement with the adaptor means of the present invention.
FIG. 5 is a bottom view of the cap structure along line 5—5 of FIG. 6.
FIG. 6 is an end view of the structure of FIG. 5.
FIG. 7 is a top view along line 7—7 of FIG. 6 of the present invention.
FIG. 8 is a detail view in partial section of another embodiment of the adaptor means of the present invention.
FIG. 9 is a detail view of the retaining member associated with the adaptor means.
FIG. 10 is a detail view of a retainer spring associated with the support of the adaptor means within the head portion.
FIG. 11 is an end view along line 11—11 of FIG. 10.
FIG. 12 is a sectional view along line 12—12 of FIG. 3.
FIG. 13 is a sectional view along line 13—13 of FIG. 3.
FIG. 14 is a sectional view along line 14—14 of FIG. 3.
FIG. 15 is a detail view of a retaining spring associated with the crank assembly to be described hereinafter.
FIG. 16 is an end view taken along line 16—16 of FIG. 3.

As best shown in FIGS. 1 and 2, the present invention relates to a wrench assembly 20 of the type designed to be hand held and operated. The wrench assembly 20 includes a housing 22 having a generally elongated configuration and having a head portion 24 integrally mounted at one end thereof. With reference to FIG. 3, the housing 22 includes a hollow portion 26 extending along the length thereof. Similarly, the head portion 22 has a hollow interior or casing 28 disposed in surrounding, supporting engagement to a gear structure 120 to be explained in greater detail hereinafter.

The elongated hollow portion 26 includes a somewhat enlarged portion 30 designed to house a first gear element 50.

More specifically, the drive means of the present invention is generally indicated as 40 and includes an elongated drive shaft 42. The drive shaft 42 is disposed to fit within the interior of the hollow portion 26. The drive means further includes a gear means including a first gear element 50 integrally secured to one end of the drive shaft 42 as best shown in FIG. 3. The drive shaft 42 is rotatably mounted within the interior of the housing wherein such rotation is aided by the provision of a plurality of ball bearing members 60 disposed about an integrally formed groove 52 adjacent end 54 of the drive shaft 42. The ball bearings 50 further travel in a groove 34 serving as a race for the bearings wherein the groove 34 has an annular configuration and is integrally formed in the interior wall portions of the enlarged hollow segment 30. The drive means further includes a second gear element 120 having a substantially annular configuration and further disposed in mating, driven engagement relative to the teeth of the first gear element 50. Accordingly, the second gear element 120 is disposed to rotate within the hollow casing 28 surrounding the second gear element 120. The second gear element 120 rotates within the interior of the casing 28 by virtue of bearing members 160 disposed in annular grooves in the upper and lower surfaces of the second gear element 120. These bearing members rest on a support ring or washer 154 (see FIG. 9) at the bottom of the casing and on the peripheral flange 144 of cap member 140 (see FIGS. 5 and 6). The adaptor means is generally indicated as 172 and includes a substantially conventionally shaped socket drive finger 170 and an intermediate base portion 174. The adaptor means 172 further includes, as seen in the embodiment of FIG. 4, a mounting head or ball portion 130 disposed in surrounded relation on the interior of the annularly shaped second gear element 120 also in the embodiment of FIG. 4. The adaptor means is secured within the interior of the second gear element 120 due to the provision of a plurality of outwardly extending key elements 132 disposed in substantially equally spaced apart relation to one another. These key elements 132 may be integrally or otherwise formed or attached to the ball element 130 and are disposed to ride and be supported within key ways 122 integrally formed on the interior of the second gear element 120. In this embodiment, the interior surface of the second gear element 120 is at least partially concave as at 123 such that the exterior curvilinear surface of the ball element 130 serves to ride on this concave surface portion. This allows an orientation of the base or shaft 174 and integrally secured socket drive 170 other than in straight perpendicular or 90 degree orientation as shown in FIG. 4. In order to accomplish engagement of bolt type connectors in hard to reach positions, the socket drive 170 is allowed to be oriented somewhat out of the straight or perpendicular orientation as pictured in FIG. 4. This is accomplished by the exterior curvilinear surface of ball 130 riding on the concave interior surface of the second gear element 120.

Further structural features of the present invention not mentioned above include the provision of integrally formed annular grooves 161 on both sides of the second gear element 120. These annular grooves are provided as races for bearing members 160 (FIG. 4) thereby allowing free rotation of the second gear element 120 within the casing 28. The ball bearings 160 rotate between the second gearing member 120 and the interior surface of retaining ring 154 and the undersurface of flange portion 144 of cap 140. (See FIG. 4). Further, the spring rings 150 are disposed within the grooves of the housing (again see FIG. 4) and insertion and detachment from the housing 24 occurs through the grasping of the projections 151 located on one surface thereof. (See FIGS. 10 and 11).

With reference to FIG. 12, each of the ball bearings 60 are positionable within annular groove 34 formed in the housing and the annular groove 52 integrally formed in the end 54 of the drive shaft 42. Placement occurs by passing each of the ball bearings 60 through threaded aperture 65. Closure of the aperture occurs by attachment of the externally threaded connector cap 63.

Further with regard to the embodiment of FIG. 4, the entire adaptor means is maintained on the interior of the second gear element 120 by virtue of spring type retainer rings 150 disposed within annular grooves as best shown in FIG. 4. Further, the retaining cap 140 has a downwardly extending tongue 142 designed to fit in the interior of a compression spring 148 which forces the cap outwardly against the upper retainer spring ring 150. This biasing by compression spring 180 further aids in the adequate placement of the socket drive 170 in operative position other than in a straight or aligned 90 degree or perpendicular relation to the head portion 24.

With regard to the embodiment of FIG. 8, the adaptor means 172' including socket drive 170' and base 174' is integrally connected to the second gear element 120'. In such an embodiment, there is no need for the ball or head structure 130 and the plurality of keys and key ways serving to floatingly mount the adaptor means 170 on the interior of the second gear element 120 as shown in FIG. 4.

Further with regard to FIGS. 1, 2, 3 and 13 through 16, the present invention further comprises an activating means generally indicated, at least in part, as 70 and including a handle portion 72. The handle portion 72 is disposed in surrounding, concentric relation to the exterior of the housing 22 at the end thereof opposite to the head portion 24. By vitue of this sleeve-like fitting within the hollow interior 74 of handle portion 72, the handle portion is rotatable relative to the housing at least in part about the exterior thereof as shown. The distal end of the drive shaft 42 as at 44 is fitted within a constricted aperture 78 and a threaded finger portion 46 is connected by an attachment nut 48 as shown. This serves to secure the end 44 of drive shaft to the handle portion 72 so as to force it to rotate therewith upon rotation of the handle portion 72. Therefore, it is readily seen that free end continuous rotation of the handle portion 72 relative to the housing 22 causes rotation of the drive shaft 42 and driving engagement between the first gear element 50 and the second gear element 120 through intermeshing engagement between gear teeth 51 and 124 respectively. This in turn causes continuous rotation of the adaptor means 172 and any wrench socket attached to the socket drive 170.

Further structural features of the present invention include the provision of a crank assembly generally indicated as 76 pivotally attached to the free end at the exterior of the handle portion 72. More specifically, the mounting of the crank assembly includes attachment of crank arm 90 by a pivot pin 94 at the end portion 92 in a manner that will cause rotation of the crank assembly 76 along with rotation of the handle portion 72. Further, the pivotal connection as at 94 of the crank arm 90 relative to the handle 72 causes its selective positioning into an inoperative, substantially stored position (shown in solid lines in FIG. 3) and its outwardly extened, operative position (shown in broken lines in FIG. 3).

When in its stored position, the crank arm 90 is disposed to recede within a channel means 80 (see FIGS. 3 and 14) wherein the crank handle 100 is pivotal between an aligned position relative to the longitudinal axis of the crank arm 90 and an outwardly extended or perpendicular position relative to the crank arm 90 as shown in best in broken lines in FIG. 3. The movable connection of the crank handle 100 to the crank arm 90 occurs through a connection by pivot pin 109 pivotally secured through flange 96. An internal compression spring 104 is disposed between the interior surface of head portion 102 and an internal annular flange integrally formed on the handle as at 106. Accordingly, the handle 100 is itself allowed to pivot about the flange 96 either into is aligned position, when the crank assembly is inoperative or its perpendicular position when the crank assembly is in its extended operative position. Therefore as shown in FIG. 3, when the crank assembly 76 is in its outwardly extended position it may be rotated continuously and somewhat rapidly about the longitudinal axis of the drive shaft 42. This causes the drive shaft 42 as well as the handle portion 72 to rotate which in turn sets the first and second gear elements into driving relation with one another. This causes the desired rotation of the adaptor means 172 and of course the rotation of the socket drive 170 which, when the wrench assembly is being utilized, would be drivingly attached to a conventional drive socket in the normal fashion. The annular spring element 49 (FIG. 15) is affixed about the connecting nut 48 is substantially surrounding relation thereto. This spring element serves to retain the crank arm either in its inoperative position or outwardly extended operative position by coming into movable abutting engagement with the end of the flange 92.

What is claimed is:

1. A wrench assembly of the type primarily designed to be hand operated and substantially continuously driven, said wrench assembly comprising:

(a) a housing having a substantially elongated configuration and a hollow interior portion extending along the length thereof, said housing further including a head portion, (b) drive means for continuously driving said wrench assembly and including an elongated drive shaft rotatably mounted within said hollow interior portion and including a first gear element mounted at one end thereof adjacent said head portion, (c) said drive means further comprising a second gear element movably mounted within said housing in meshing driven engagement with said first gear element, whereby rotation of said drive shaft causes rotation of said first and second gear element, (d) activating means movably mounted on said housing for driving interconnection with said drive shaft, (e) adaptor means movably mounted on the interior of said second gear element and including a mounting head having a plurality of key elements fixedly formed thereon in spaced relation to one another and each extending outwardly from an outer surface of said mounting head in substantially coplanar relation to one another, (f) said second gear element comprising a plurality of keyways integrally formed therein, wherein each of said key elements is disposed and dimensioned to fit within one of said keyways, (g) said adaptor means mounted to rotate with said second gear means upon interengagement between respective ones of said key elements and keyways, (h) said second gear element including at least a partially concave interior surface disposable substantially in supporting and sliding engagement with an exterior surface of said adaptor means, (i) said adaptor means extending outwardly from said head portion and positionable in a substantially floating manner and orientation including and limited to 90° relative to said head portion, and (j) said activating means, said drive means and said adaptor means all interconnected and structured to cause substantially continuous rotation of said adaptor means upon continuous rotation of said activating means through interconnection thereof by said drive means.

2. A wrench assembly as in claim 1 wherein said head portion comprises a casing structured for supporting and at least partially surrounding relation to said second gear element, aperture means disposed in communicating relation between said casing interior and said hollow interior portion, said first and said second gear elements each structured and cooperatively disposed into intermeshing engagement through said aperture means.

3. A wrench assembly as in claim 1 wherein said activating means comprises a handle means rotatably mounted on said housing and fixedly secured to said drive means whereby rotation of said activating means causes rotation of said drive means and said adaptor means.

4. A wrench assembly as in claim 1 wherein said activating means comprises a crank assembly rotatably mounted on said housing and interconnected to said drive shaft to cause rotation thereof upon rotation of said crank assembly relative to said housing.

5. A wrench assembly as in claim 4 wherein said crank assembly comprises a crank arm pivotally interconnected to said housing and disposable between an inoperative position and an operative position, said inoperative position defined by folded orientation of said crank arm substantially adjacent the exterior of said housing, said operative position defined by an outwardly extended orientation of said crank arm relative to said housing and thereby positioned for selective continuous rotation relative to said housing.

6. A wrench assembly as in claim 5 wherein said activating means further comprises a handle means rotatably mounted on said housing and fixedly secured to said drive means such that rotation of said handle means causes rotation of said drive means, whereby said crank arm is pivotally secured to said handle element such that rotation thereof causes rotation of said handle element and attendant rotation of said drive means.

7. A wrench assembly as in claim 6 further comprising channel means formed in said handle means and dimensioned and disposed to receive said crank arm therein when disposed in its inoperative position.

* * * * *